US009493950B2

(12) United States Patent
Yang

(10) Patent No.: US 9,493,950 B2
(45) **Date of Patent: *Nov. 15, 2016**

(54) COMPOSITE I-BEAM MEMBER

(71) Applicant: WeiHong Yang, Sunnyvale, CA (US)

(72) Inventor: WeiHong Yang, Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/541,130

(22) Filed: Nov. 13, 2014

(65) Prior Publication Data

US 2015/0135638 A1 May 21, 2015

Related U.S. Application Data

(63) Continuation-in-part of application No. 13/772,338, filed on Feb. 21, 2013, now Pat. No. 8,910,455, which is a continuation-in-part of application No. 13/225,518, filed on Sep. 5, 2011, now abandoned, which is a continuation of application No. 12/804,601, filed on Mar. 19, 2010, now abandoned.

(51) Int. Cl.

| | |
|---|---|
| ***E04C 3/292*** | (2006.01) |
| ***E04C 3/18*** | (2006.01) |
| ***E04C 3/46*** | (2006.01) |
| ***E04C 3/12*** | (2006.01) |

(52) U.S. Cl.

CPC ..... *E04C 3/292* (2013.01); *E04C 3/18* (2013.01); *E04C 3/46* (2013.01); *E04C 3/122* (2013.01); *Y10S 52/06* (2013.01); *Y10T 29/49623* (2015.01); *Y10T 29/49634* (2015.01); *Y10T 29/49826* (2015.01)

(58) Field of Classification Search

CPC ..... E04C 3/26; E04C 3/29; E04C 3/46; E04C 3/291; E04C 3/292; E04C 2003/0452

USPC ..... 52/223.1, 223.4, 223.8, 837, 838, 847, 52/DIG. 6, 841, 842, 745.19; 29/428, 29/897.3, 897.35

See application file for complete search history.

(56) References Cited

U.S. PATENT DOCUMENTS

| | | | | |
|---|---|---|---|---|
| 1,453,996 | A * | 5/1923 | Riddle | E04C 3/29 52/376 |
| 2,099,470 | A * | 11/1937 | Coddington | E04C 3/293 52/301 |
| 2,126,622 | A * | 8/1938 | Davis | E04B 1/4171 52/368 |
| 2,200,159 | A * | 5/1940 | Davis, Jr. | E04C 3/08 52/376 |
| 2,387,432 | A * | 10/1945 | Du Laney | E04C 3/29 52/376 |
| 3,349,537 | A * | 10/1967 | Hopfeld | B29C 70/20 182/219 |

(Continued)

FOREIGN PATENT DOCUMENTS

EP 0115769 A2 * 8/1984

*Primary Examiner* — Rodney Mintz

(74) *Attorney, Agent, or Firm* — Law Office of Dorian Cartwright; Dorian Cartwright

(57) ABSTRACT

A composite steel I-beam member. The member includes confined top and bottom flanges, and a composite laminated web. The confined flange comprises a wooden core and a metal jacket wrapped around an outer perimeter of the wooden core. The overall load carrying capacity of the composite I-beam is significantly increased through a list of composite actions occurring in the individual components and their connections. Most importantly, a two-way lateral interaction can be normal to the interface between the metal jacket and the wooden core and provide an amount of compressive support to the top flange surpassing the sum of amount of support provided by the metal jacket and the wooden core when being used separately.

18 Claims, 16 Drawing Sheets

(56) References Cited

U.S. PATENT DOCUMENTS 3,605,360 A * 9/1971 Lindal ..... B27H 1/00 52/223.8
4,281,497 A * 8/1981 Luotonen ..... E04C 3/292 52/601
5,308,675 A * 5/1994 Crane ..... E04C 3/29 181/208
5,875,605 A * 3/1999 Rudd ..... E04C 3/292 52/376
6,457,292 B1 * 10/2002 Vrana ..... E04C 3/292 411/461
6,460,310 B1 * 10/2002 Ford ..... E04C 3/14 52/837
8,166,721 B1 * 5/2012 diGirolamo ..... E04C 3/292 52/455
8,820,033 B2 * 9/2014 Yang ..... E04C 3/17 29/428
8,857,037 B2 * 10/2014 Kelly ..... B23P 15/00 148/550
8,910,455 B2 * 12/2014 Yang ..... E04C 3/292 29/428
9,103,130 B2 * 8/2015 Calvo Echeveste ..... E04C 3/29 249/211
2002/0144484 A1 * 10/2002 Vrana ..... E04C 3/292 52/842
2004/0226254 A1 * 11/2004 Charlwood ..... E04C 3/07 52/834
2005/0166530 A1 * 8/2005 Wilson ..... E04C 3/292 52/841
2006/0032182 A1 * 2/2006 Carlson ..... E04C 3/29 52/837
2007/0137137 A1 * 6/2007 Peek ..... E04C 3/14 52/837
2007/0256389 A1 * 11/2007 Davis ..... E04B 5/12 52/841
2008/0282633 A1 * 11/2008 Buckholt ..... E04B 1/78 52/309.8
2011/0167759 A1 * 7/2011 Cesternino ..... B32B 1/00 52/834
2011/0252743 A1 * 10/2011 Yang ..... E04B 1/2403 52/849
2012/0011805 A1 * 1/2012 Yang ..... B32B 15/10 52/834
2012/0298943 A1 * 11/2012 Yang ..... E04B 1/30 256/13.1
2013/0055677 A1 * 3/2013 Hayden ..... B29C 70/865 52/835
2013/0160398 A1 * 6/2013 Yang ..... E04C 3/292 52/841
2013/0239512 A1 * 9/2013 Yang ..... E04C 3/17 52/741.3
2014/0083046 A1 * 3/2014 Yang ..... E04B 1/24 52/704
2014/0096476 A1 * 4/2014 Kim ..... E04B 1/20 52/841
2014/0145062 A1 * 5/2014 Calvo Echeveste ..... E04C 3/29 249/211
2014/0182234 A1 * 7/2014 Yang ..... E04B 1/24 52/655.1
2015/0052838 A1 * 2/2015 Ritchie ..... E04C 3/29 52/408

* cited by examiner

COMPOSITE I-BEAM MEMBER

FIELD OF THE INVENTION

The present invention relates generally, to construction material, and more specifically, to a composite I-beam member used for light-framed construction.

CROSS-REFERENCE TO RELATED APPLICATIONS

This application claims the benefit of priority as a continuation-in-part to U.S. patent application Ser. No. 13/772,338, filed on Feb. 21, 2013, entitled COMPOSITE I-BEAM MEMBER, by WeiHong Yang, which claims the benefit of priority as a continuation-in-part to U.S. patent application Ser. No. 13/225,518, filed on Sep. 5, 2011, entitled COMPOSITE GUARDRAIL POSTS AND COMPOSITE FLOOR I-JOIST, by WeiHong Yang, and to U.S. patent application Ser. No. 12/804,601, filed on Mar. 19, 2010, entitled STEEL-WOOD COMPOSITE STRUCTURE WITH METAL JACKET WOOD STUDS AND RODS, by WeiHong Yang, the contents of each being hereby incorporated by reference in its entirety.

BACKGROUND

I-beams are shaped like the letter "I" to maximize the moment of inertia, which in turn maximizes its resistance to bending and deflection when used as a beam or floor joist. It is well known that I-beams are the most efficient structural members when subjected to bending, and they are widely used in both light-framed and heavy-duty constructions.

In light-framed construction, support for structures is conventionally provided by members composed of a single material, predominantly either wood or metal. These single-material members are often vulnerable to failure due to characteristics of the material. For examples, while wood is weak in tension and very vulnerable to fire and termite; a metal stud has inherent problems of pre-mature failure due to weak connection and local buckling. Conventional steel I-beams can be very heavy. Furthermore, use of certain materials can have a negative effect on the environment. For example, inefficient use of timber wastes trees, a valuable natural resource. Also, timber is often treated for use in exterior construction which can add pollutants to the environment. In another example, pressure treated wood produces a large volume of waste water with pollutants.

In heavy duty construction, composite techniques are often used to achieve higher structural performance. A composite structure combines different materials together to form a new structure. Since it fully utilizes the potential of individual materials, the advantages of composite structures have been well recognized in the engineering community during the past decades.

However, past applications, such as concrete-filled steel tubes and composite floor decks, mostly involve combining steel and concrete in various forms, and are primarily used in commercial buildings and infrastructures.

What is needed is to introduce composite techniques in light-framed construction to allow for lighter and stronger I-beam members.

SUMMARY

The above needs are met by an apparatus, system, method and method of manufacture for a composite I-beam member.

In one embodiment, a confined top flange comprises a wooden core and a metal jacket wrapped around an outer perimeter of the wooden core and two inner side walls of an rectangular channel slotted along the longitudinal direction within the wooden core. The metal jacket is pre-stressed to confine the wooden core, providing a two-way lateral interaction. The two-way lateral interaction can be normal to the interface between the metal jacket and the wooden core and, when subjected to compression, provide an amount of support to the top flange surpassing the sum of amount of support provided by the metal jacket and the wooden core when being used separately.

A confined bottom flange comprising substantially a mirror image of the composite top flange. When subjected to tension, the metal jacket alone is capable to provide adequate tensile force to counteract the compressive force of the top flange.

A web board, either a regular wooden board or a composite laminated board, can have a top edge portion inserted into and locked with the confined top flange and a bottom edge portion inserted into and locked with the confined bottom flange using metal connectors. In one embodiment, the metal connectors can penetrate an entire width of the composite top and bottom flanges at, for example, the mid-height of inner side walls of the slotted channel. In other embodiments, the metal connectors can penetrate partially into the composite top and bottom flanges at either horizontal or diagonal directions. In one embodiment, localized composite action at the connection between the laminated web and confined flange can increase the capacity of the dowel connection significantly. This composite action is similar to the two-way lateral interaction of the flange, but at a localized region around each metal connector. In this case, the confinement effect is originated from the pre-compression of the metal connector, not the metal jacket. For example, tightening of a nut to a pre-compression when the metal connector is a bolt.

When the shear demand is small, in an embodiment, the web board comprises a wooden board. As the shear demand increases, the capacity provided by wooden board may become inadequate, then composite laminated web can be used to increase capacity and ductility under shear loading. When the shear demand is moderate, one-sided composite laminated board (i.e. a wooden board bonded on one side by one metal cover) may be adequate. However, when additional shear capacity is still needed for certain heavy duty application, sandwiched composite laminated web (i.e. a wooden board sandwiched between two metal covers, possibly made of light gauged sheet metal) can be employed to achieve highest composite performance.

For the composite laminated web, the wooden board provides lateral support to the metal sheet and prevent it from pre-mature lateral buckling, so that the metal sheet can develop the full tensile potential of the metal material, which is so-called one-way lateral interaction. The one-way interaction can also be normal to an interface between the outer metal sheets and the inner wooden board. When it is a wooden board, shear capacity is provide 100% by wooden board; when it is one-sided composite laminated board, the shear capacity is provided by both the metal sheet and the wooden board. When it is sandwiched composite laminated board, the shear capacity is mostly provided by the metal sheet, and the wooden board itself provide very little shear capacity if any at all.

The metal connectors may be bolts, screws, nails and/or staples in various embodiments. The bolts and/or screws may be applied horizontally. The screws, nails and/or staples may be applied diagonally.

Advantageously, the composite I-beam member is stronger than wood I-beams, and is also lighter than conventional steel I-beams.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

An apparatus, system, method, and method of manufacture for a composite I-beam member, are described herein. The following detailed description is intended to provide example implementations to one of ordinary skill in the art, and is not intended to limit the invention to the explicit disclosure, as one of ordinary skill in the art will understand that variations can be substituted that are within the scope of the invention as described.

Figure 1:
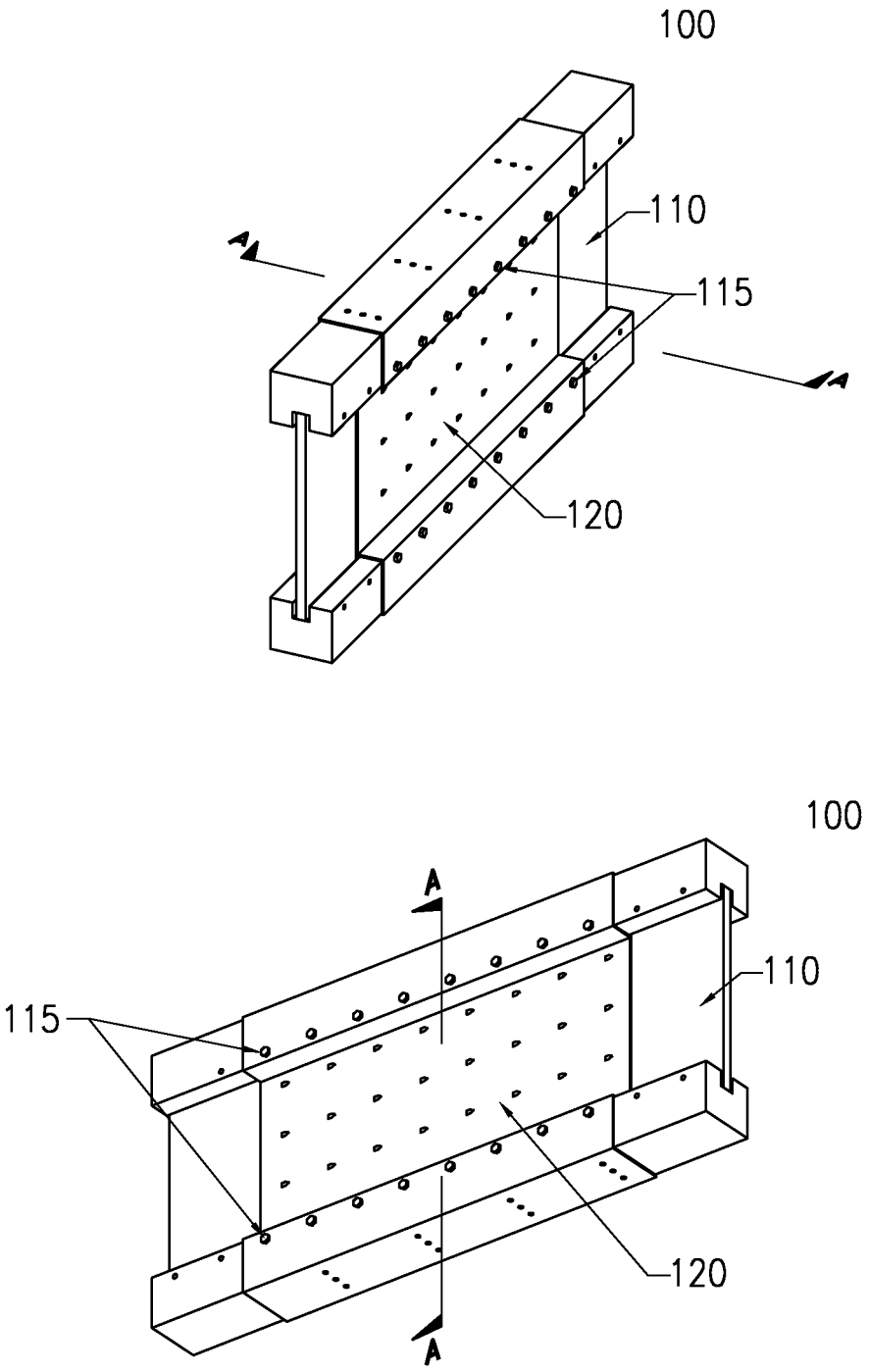
FIG. 1 is a schematic diagram illustrating two different views of a composite I-beam member, according to an embodiment.

FIG. 1 is a schematic diagram illustrating two different views of a composite I-beam member 100, according to an embodiment. The member 100 comprises a wooden core 110 and a metal jacket 120 wrapped around an outer perimeter of the wooden core. The wooden core 110 can be manufactured from an appropriate construction grade lumber, a solid nature wood, an engineered wood or pressed wood. Other materials can be substituted for the wooden core within the spirit of the current invention. The metal jacket 120 can be any type of sheet metal, such as a light-gauged cold-formed steel sheet, an aluminum sheet, a copper sheet, an alloy or any appropriate substitute material. Cross-section A-A will be further discussed in FIGS. 4 to 9 below with regards metal connectors penetrating 5 or fewer layers of metal either horizontally and/or diagonally.

The member 100 can be a conventional I-beam configuration having a web, a top flange and a bottom flange, as is discussed below with respect to FIG. 2. The dimensions and ratio of the web to flanges can be modified for a particular use (e.g., floor beam versus post). The wooden core 110 can also be shaped as a square, a rectangle, a circle, or any appropriate shape. The member can serve as any type of supporting member, for interior or exterior construction, including a beam, post, or joist, used individually or as part of a combination of members.

The member 100 is configured as a confined top flange and a confined bottom flange coupled to either end of a composite laminated web. In one embodiment, the metal jacket 120A is wrapped around the top core 110A, in a pre-stressed manner, to provide a two-way lateral interaction. The interaction can be normal to an interface between the metal jacket 120A and the wooden core 110A. When the top core is subjected to compression, the two-way lateral interaction generates an amount of amount of support to the top flange that surpasses a sum of an amount of support provided by the metal jacket and the wooden core when being used separately. In other words, the two-way lateral interaction makes the composite top flange stronger than the individual components.

More specifically, the wooden core 110A fails at a certain pressure at which the wood dilates. As the wood dilates, splits within the wooden core 110 open up spaces that span the length or height by opening up spaces within. However, the metal jacket 120A resists the splitting action and maintains integrity in the wooden core 110A beyond the point of individual failure. As a result, the compressive strength and ductility of the top flange is increased.

Similarly, the metal jacket 120A fails at a certain pressure at which the metal buckles. As the metal buckles, rather than opening up spaces as does the wood, the metal folds over itself. In response, the wooden core 110A resists the buckling action and maintains integrity in the metal jacket 120A beyond the point of individual failure. Further, premature local buckling is prevented.

Figure 2:
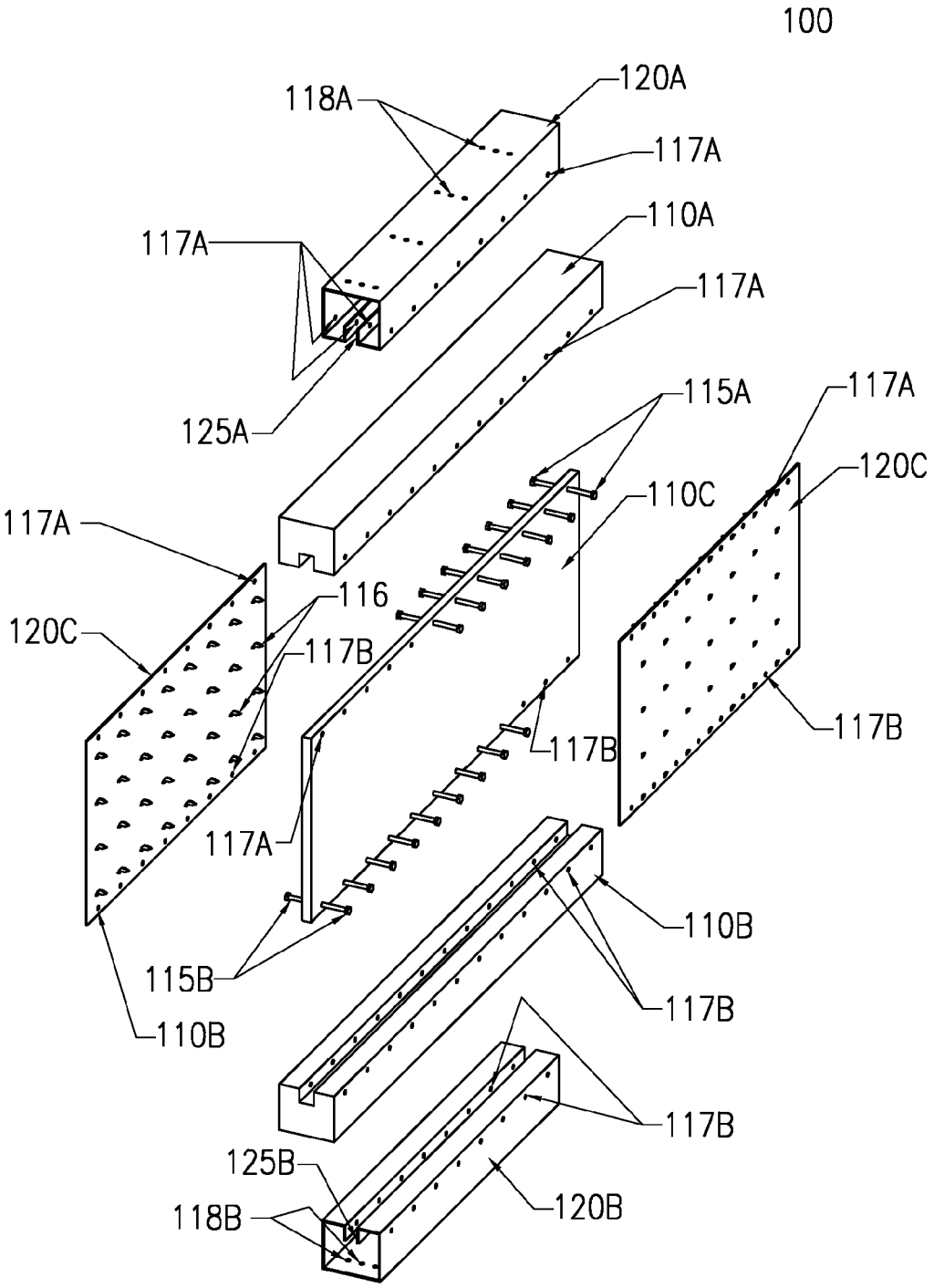
FIG. 2 is a first view of an exploded schematic diagram illustrating a composite I-beam member, according to an embodiment.
Figure 3:
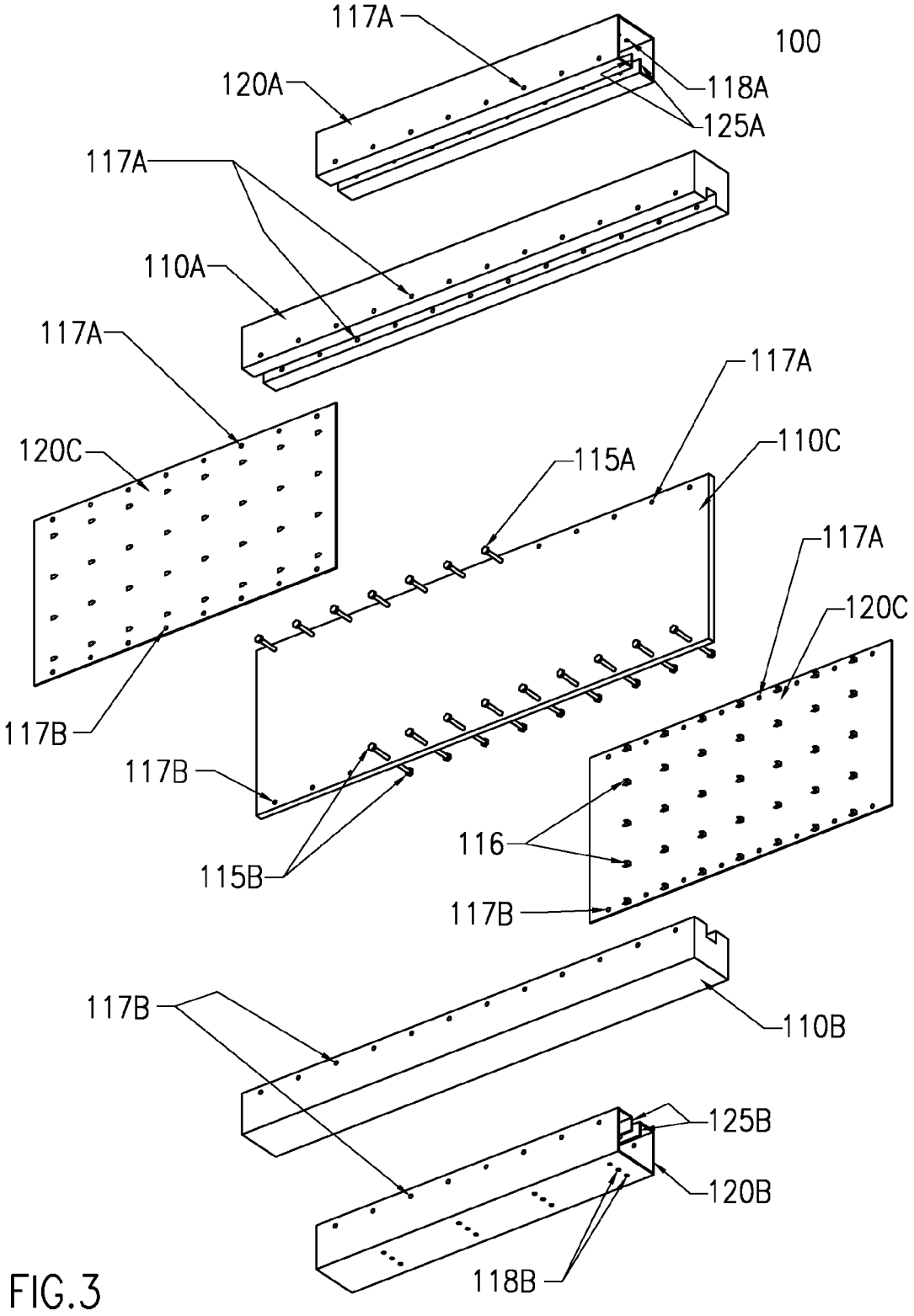
FIG. 3 is a second view of an exploded schematic diagram illustrating a composite I-beam member, according to an embodiment.

FIGS. 2 and 3 are first and second views of an exploded schematic diagram illustrating a composite I-beam member, according to an embodiment. The exploded view highlights individual components of the member 100. The member 100 includes a wooden top flange 110A, a wooden bottom flange 110B and a wooden web 110C. Further, the member 100 includes a metal top flange 120A, a metal bottom flange 120B, and metal covers 120C. Also, member includes connectors 120D that can be metal, for example, bolts, screws, rivets, nails and/or staples. The connectors 120D can be applied in various manners and penetrate various numbers of layers as discussed more fully below.

Metal jackets are wrapped around wooden cores. For example, the metal top flange 120A is wrapped around the wooden top flange 110A, and the other parts are similarly wrapped. In more detail, the metal top flange 120A wraps around surface portions of the wooden top flange 110A, and in some embodiments, along the inner side walls of a slotted channel spanning a length of the wooden top flange 110A. In some embodiments, the two opposing inner side walls of the slotted channel are wrapped while a third end side remains unwrapped. The metal top flange 120A is wrapped to generate a pre-stress for confinement of the wooden top flange 110A. The bottom flange 120B can be substantially a mirror image of the top flange 120A.

The wooden top and bottom flanges 110A and 110B are both slotted along the length to form a channel in the center of one surface. The flanges can be square (for example, as in FIGS. 1-6), round (for example as in FIGS. 7-9), or other shapes. The width of the slotted channel is slightly wider than the thickness of the wooden web 110C, so as to accommodate the thickness of wooden web 110C plus the edges of four layers of light-gauged metal. When the bottom flange is subjected to tension, there is no meaningful composite action in some embodiments (i.e., no one-way or two-way lateral interaction). The metal jacket 120B alone is capable to provide adequate tensile capacity, and that of the wooden core 110B becomes negligible.

A height 125A,B of the metal flanges 120A,B determines how much of a rectangular channel of the wooden cores 110A,B is covered by metal. Some embodiments cover no or less than half of a channel height, some cover about half, and others cover more than half to almost all. The metal flange height 125A,B determines how many layers metal connectors 120D pierce, as described more below.

In an embodiment, the composite laminated web 120 comprises a wooden board sandwiched between two light-gauged metal covers. The wooden web 110C provides lateral support to the metal cover 120C and prevent it from premature lateral buckling, so that the metal sheet can develop the full tensile potential of the metal material, which is so-called one-way lateral interaction. The one-way interaction can also be normal to an interface between the outer metal sheets and the inner wooden board. When subjected to shear force, the shear capacity is mostly provided by the metal sheet, and the wooden board itself provide very little shear capacity if any at all.

The composite laminated web 120 only accounts for shear force support. In one embodiment, the wooden web 110C is sandwiched by the metal cover 120C, and provide a one-way lateral interaction. The interaction can be normal to an interface between the metal cover 120C and the wooden web 110C. More specifically, the wooden web 110C provides lateral support to the metal cover 120C and prevent it from pre-mature lateral buckling, so that the metal cover can develop the full tensile potential of the metal material. The shear capacity is mostly provided by the metal sheet, and the wooden web 110C primarily help to increase the shear capacity of the metal cover, but the wooden web 110C itself provides very little shear capacity if any at all. In another embodiment, the composite action of the laminated web can increase the capacity of the dowel connection 120D significantly. The presence of wooden web 110C can prevent pre-mature tear-off failure of the metal covers, and the confinement effect of metal covers that may sandwich the wooden web 110C can significantly increase local bearing capacity of wooden web 110C, so that a much higher shear force can be reliably transferred between the composite laminated web 120 and flange through the connectors 120D.

In one embodiment, localized composite action at the connection between the composite laminated web 120 and confined flange can increase the connection capacity significantly. This composite action is similar to the two-way lateral interaction of the flange, but at a localized region around each metal connector. In this case, the confinement effect is originated from the pre-compression of the metal connector, not the metal jacket. For example, tightening of a nut to a pre-compression when the connector is a bolt.

Figure 4A:
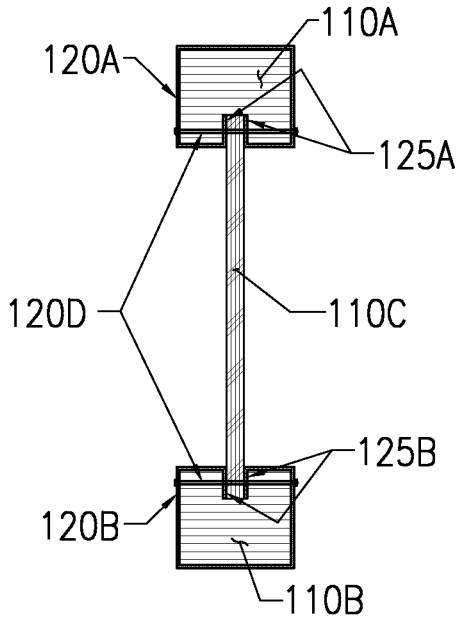
FIGS. 4A to 4E are schematic diagrams of the cross section A-A of FIG. 1 showing examples of various metal connectors penetrating 1 to 4 layers of metal with wooden web.
Figure 4B:
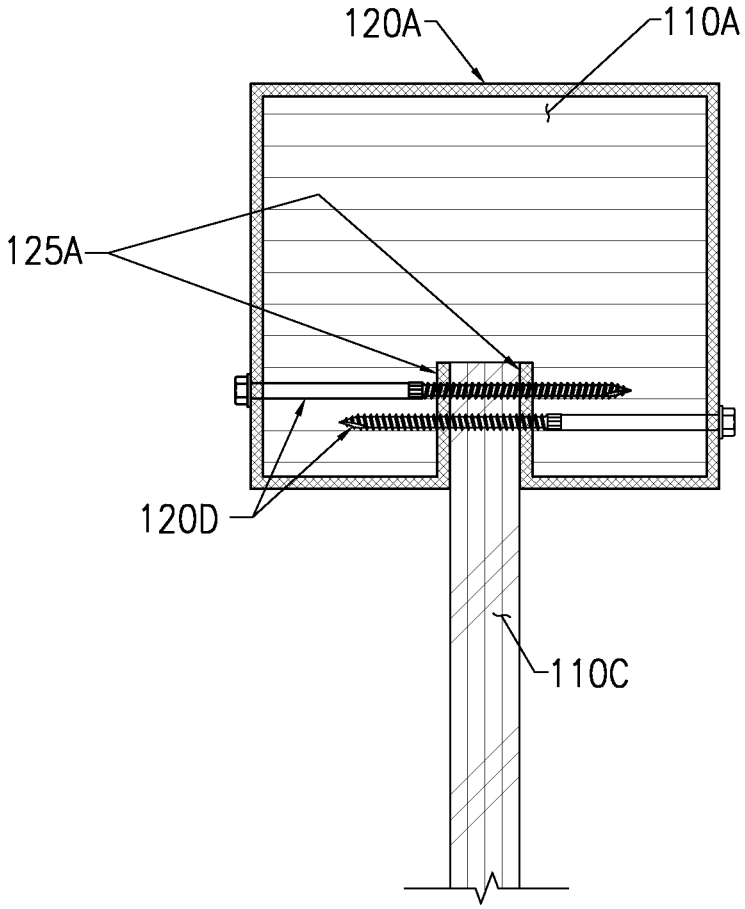
Figure 4C:
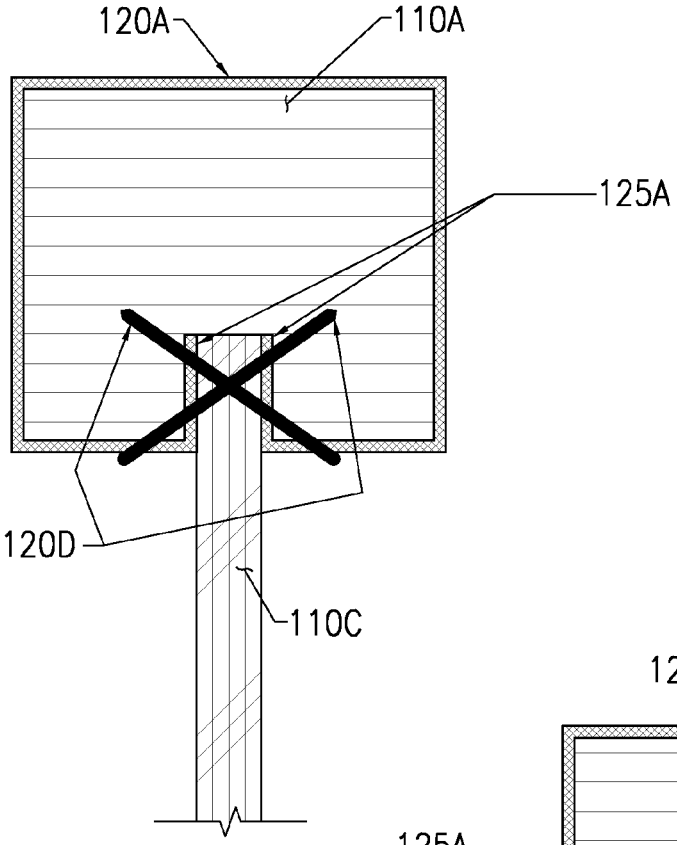
Figure 4D:
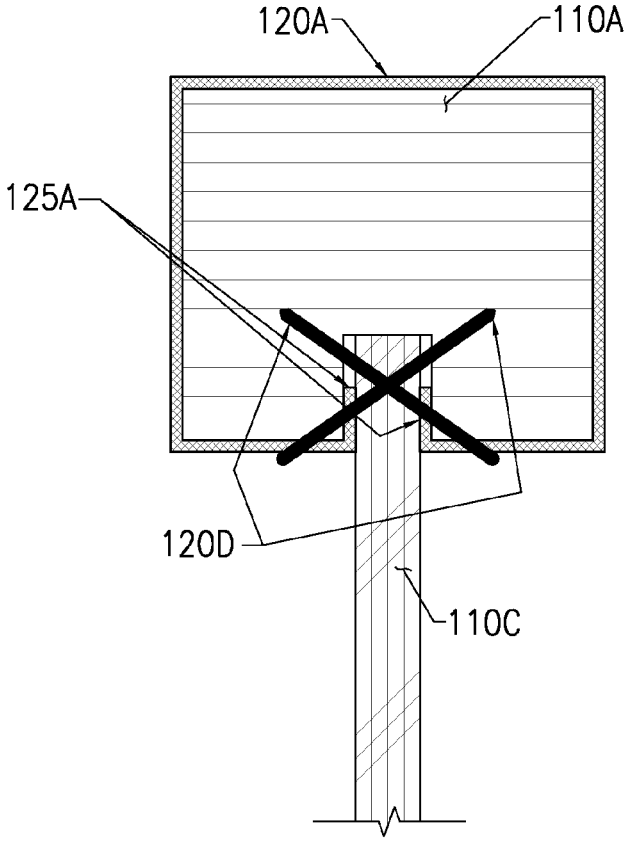
Figure 4E:
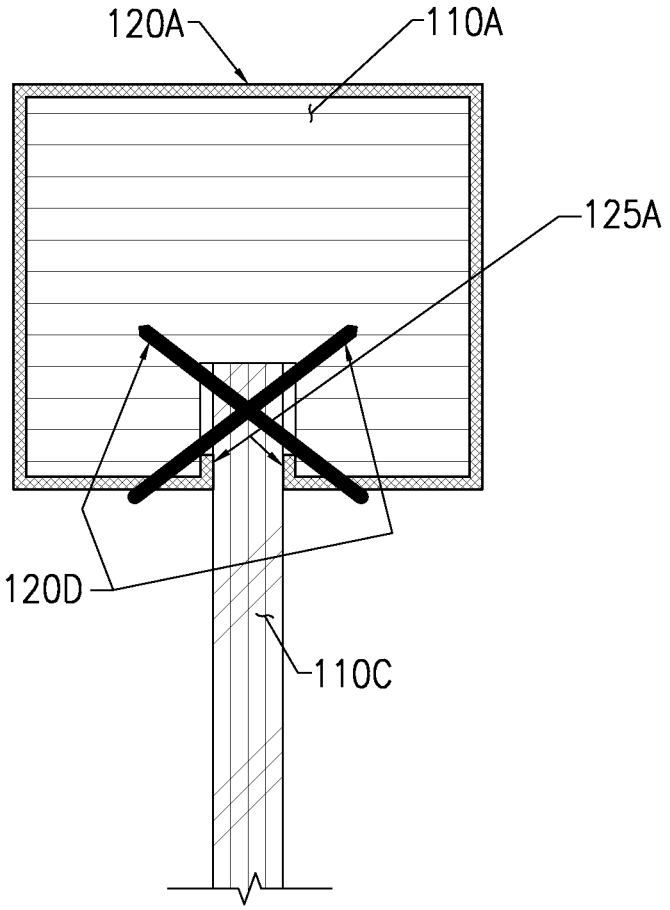
Figure 5A:
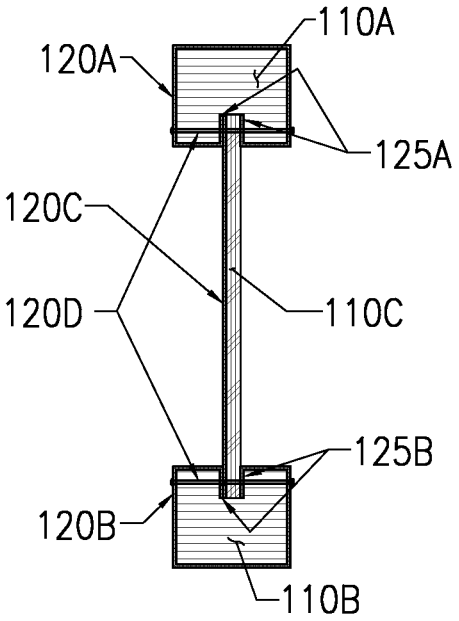
FIGS. 5A to 5E are schematic diagrams of the cross section A-A of FIG. 1 showing examples of various options for insertion of metal connectors penetrating 2 to 5 layers of metal covers sandwiched between one metal cover, in various embodiments.
Figure 5B:
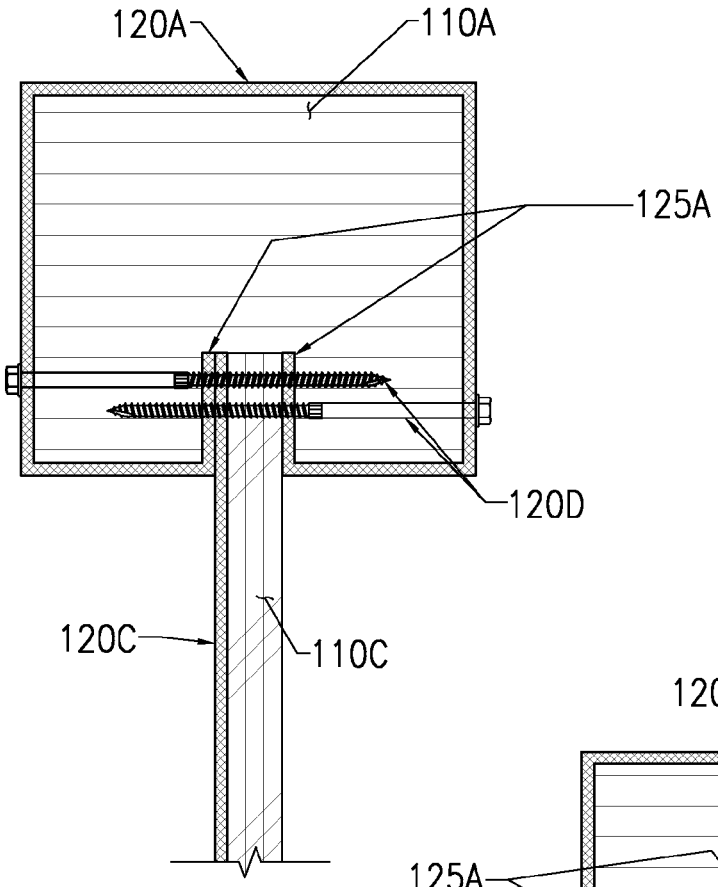
Figure 5C:
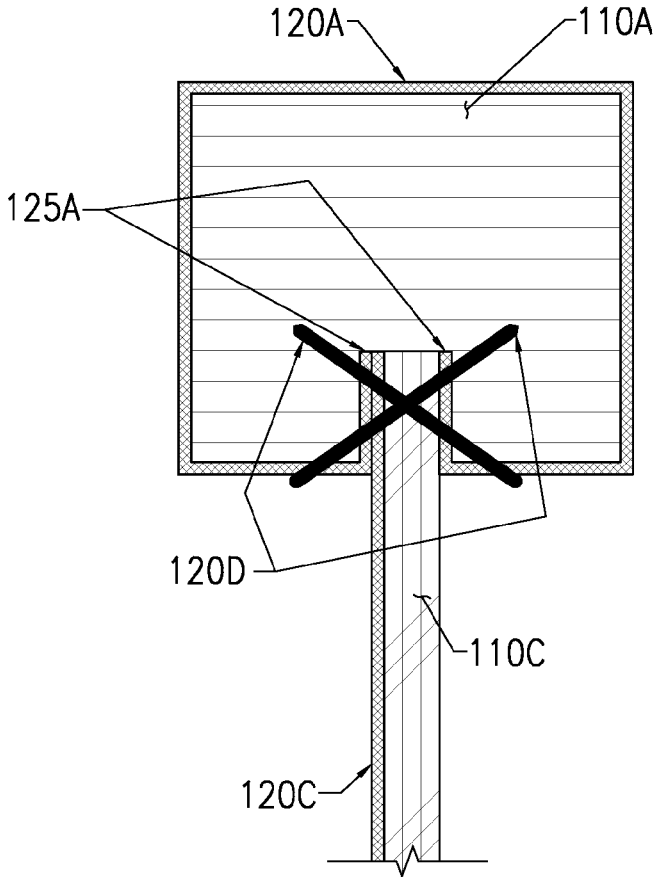
Figure 5D:
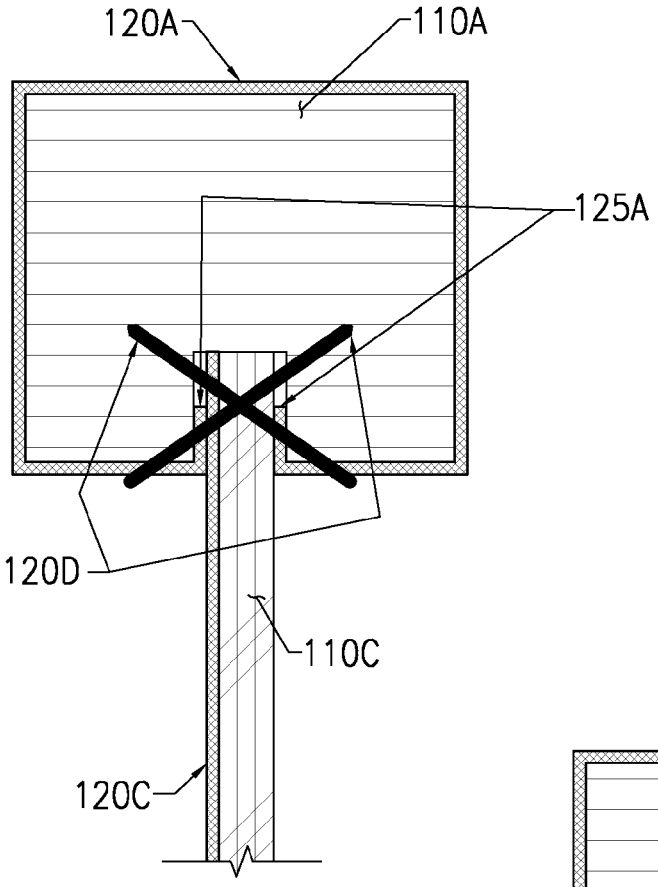
Figure 5E:
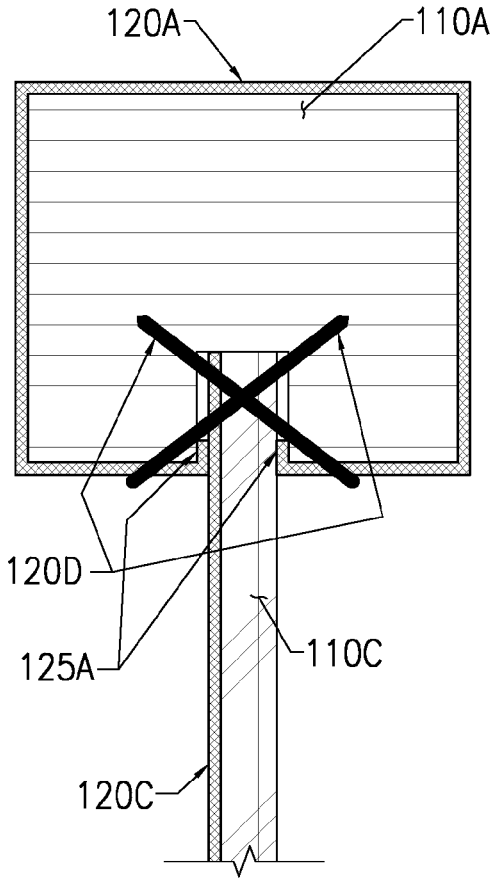
Figure 6A:
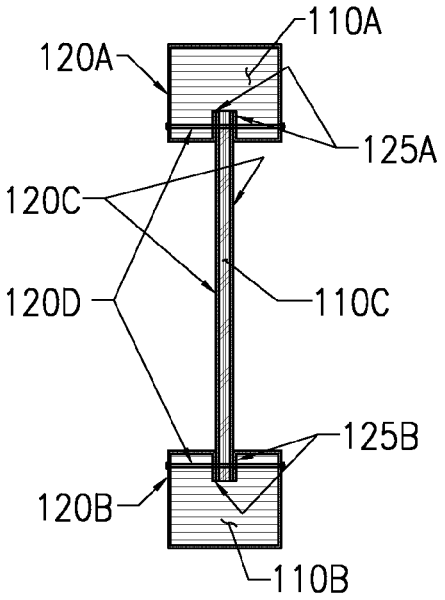
FIGS. 6A to 6E are schematic diagrams of the cross section A-A of FIG. 1 showing examples of various metal connectors penetrating 3 to 6 layers of metal with wooden webs sandwiched between two metal covers, in various embodiments.
Figure 6B:
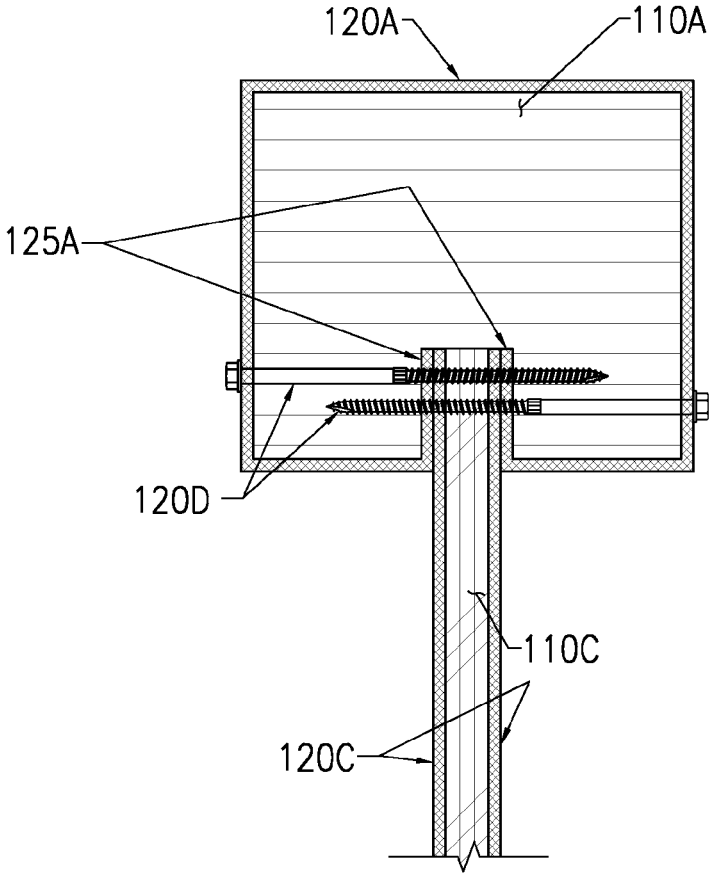
Figure 6C:
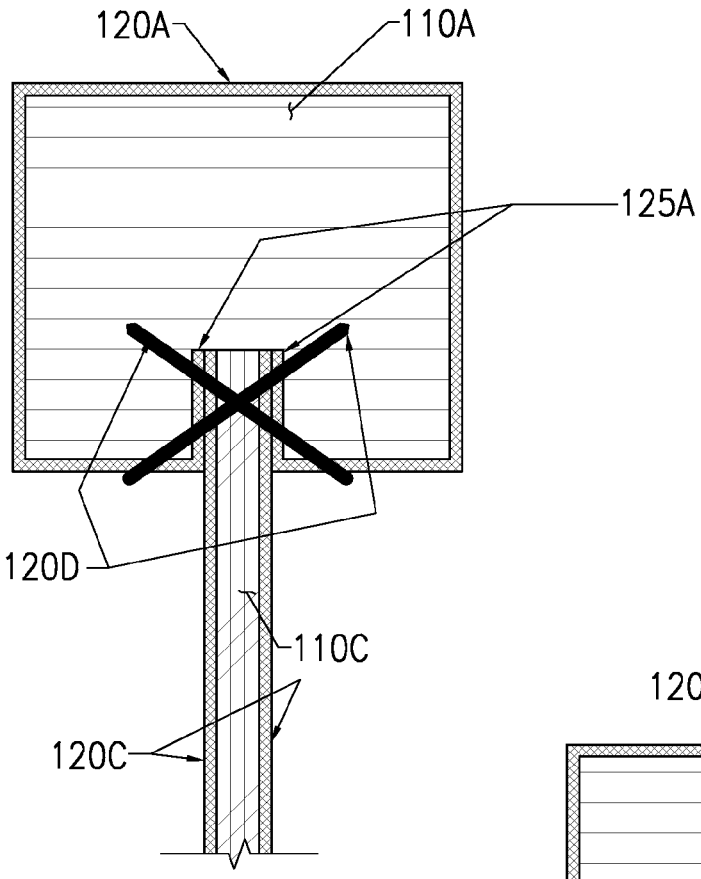
Figure 6D:
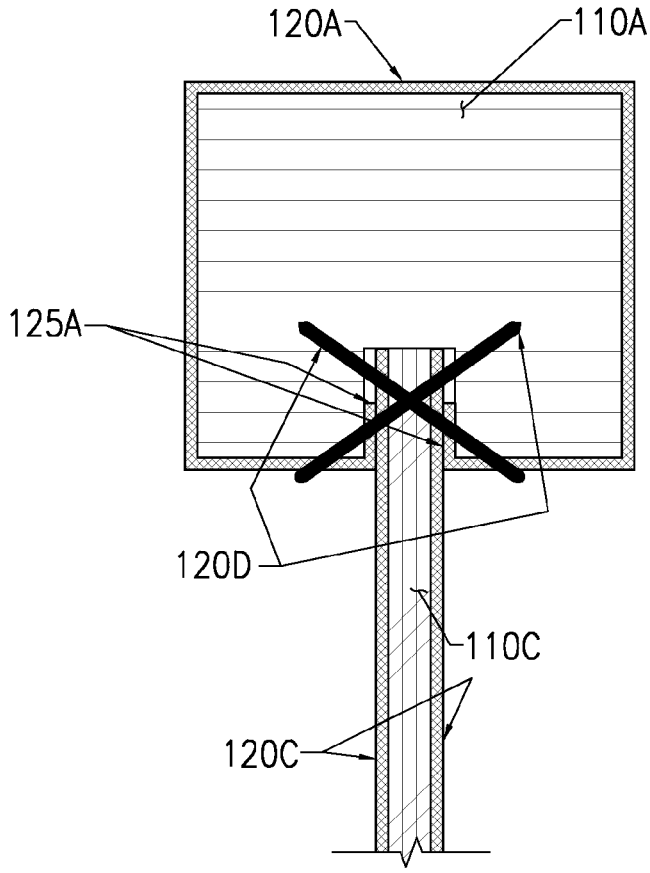
Figure 6E:
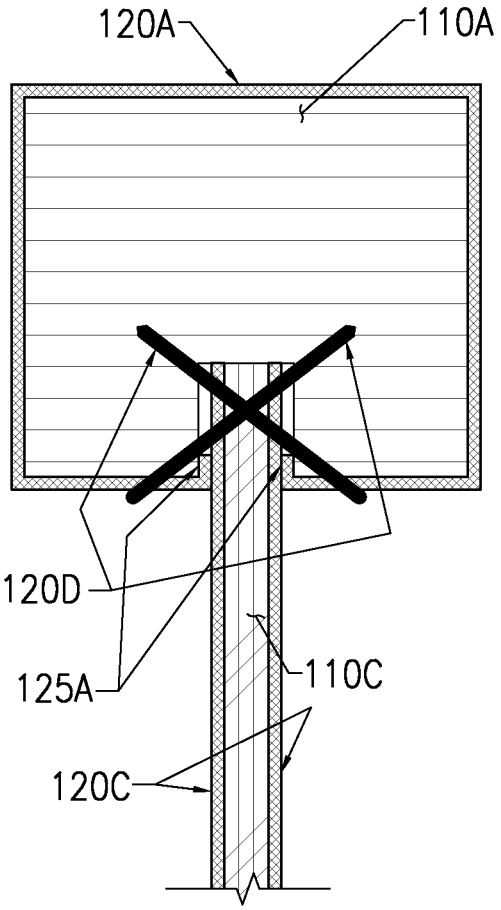
Figure 7A:
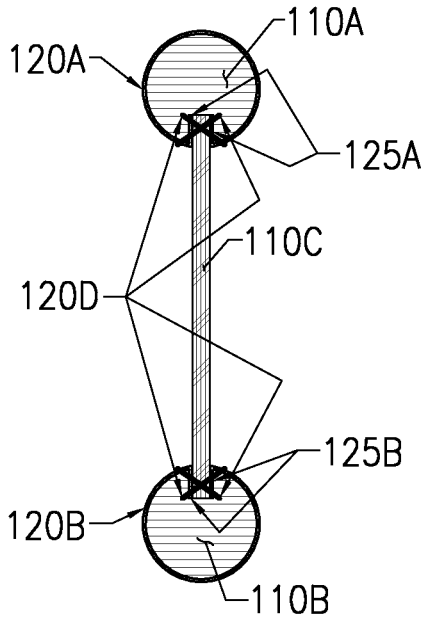
FIGS. 7A-C are schematic diagrams of the cross section A-A of FIG. 1 showing each wooden core having a circular cross section with various metal connectors penetrating 3, 2 or 1 metal layers through the flanges into the laminated composite web as a wooden web, in various embodiments.
Figure 7B:
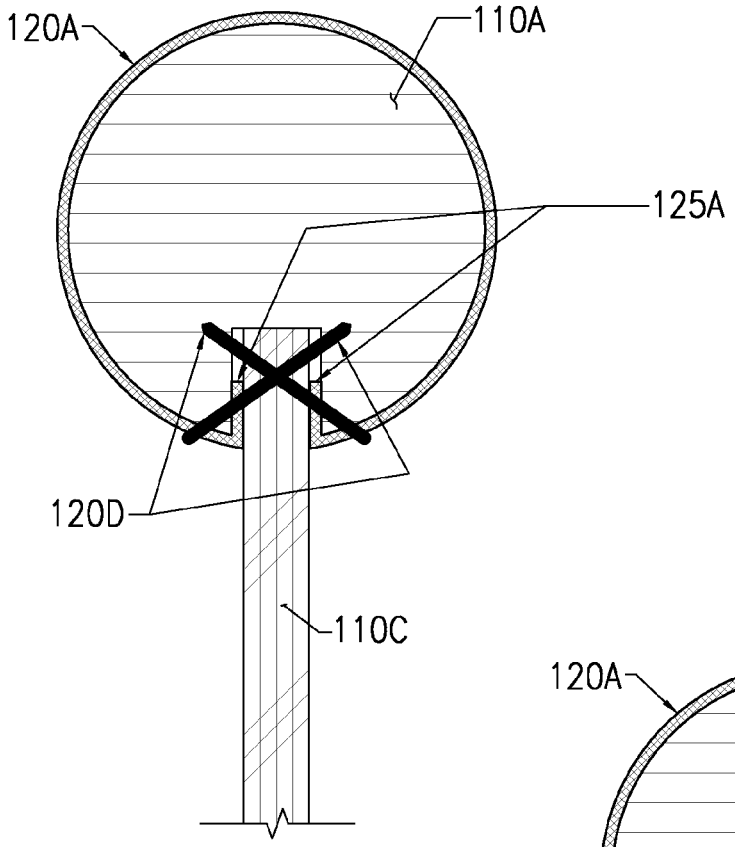
Figure 7C:
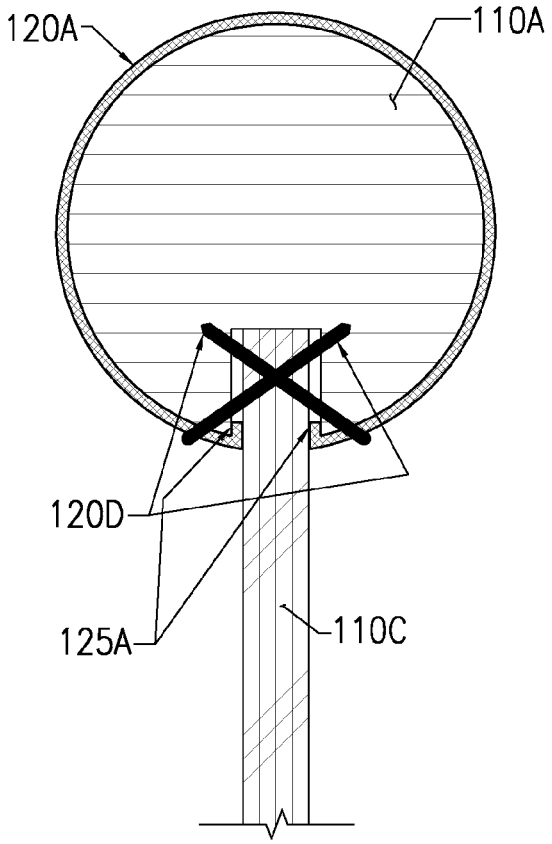
Figure 8A:
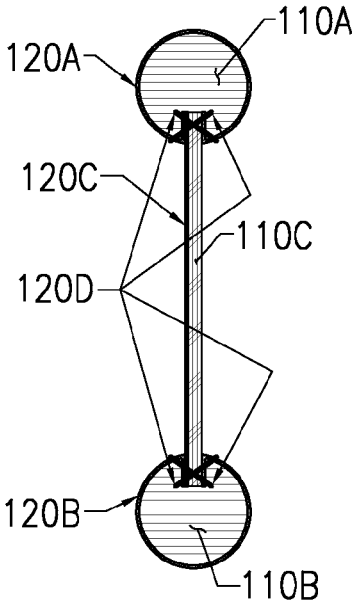
FIGS. 8A-C are schematic diagrams of the cross section A-A of FIG. 1 showing a wooden core having a circular cross section with various metal connectors penetrating 4, 3, or 2 metal layers through the flanges into the laminated composite web with a metal cover on one side, in various embodiments.
Figure 8B:
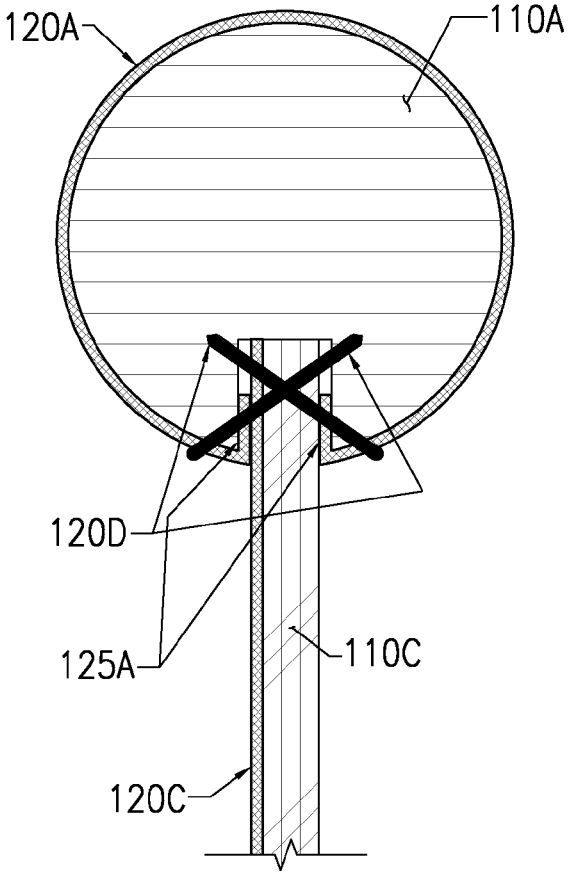
Figure 8C:
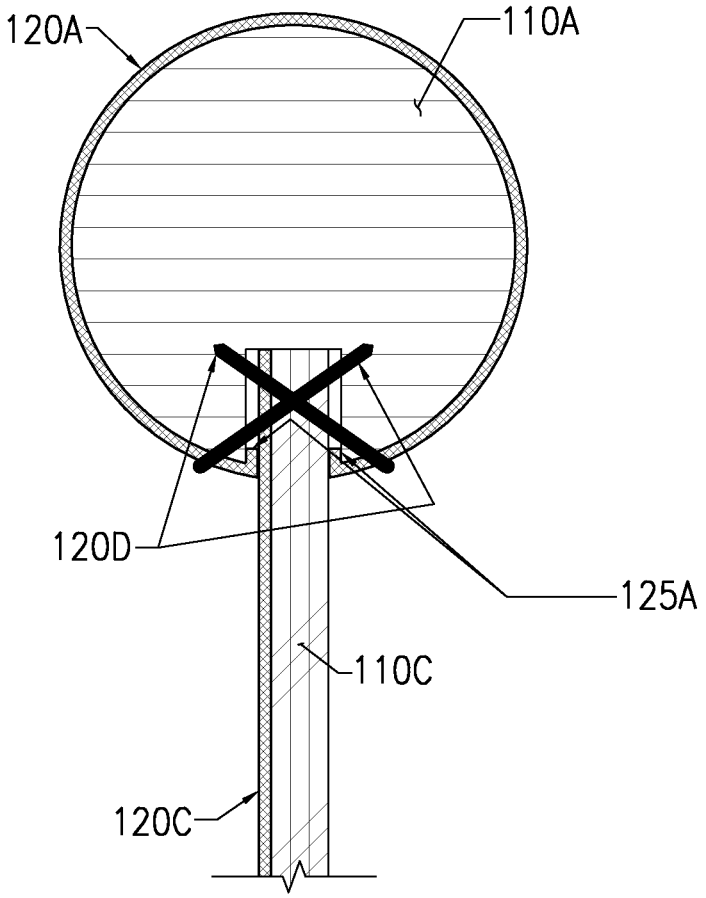
Figure 9A:
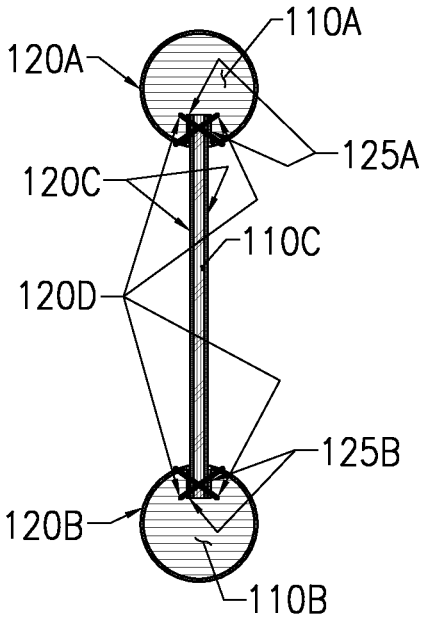
FIGS. 9A-C are schematic diagrams of the cross section A-A of FIG. 1 showing a wooden core having a circular cross section with various metal connectors penetrating 5, 4, or 3 metal layers through the flanges into the laminated composite web sandwiched between metal covers on both sides, in various embodiments.
Figure 9B:
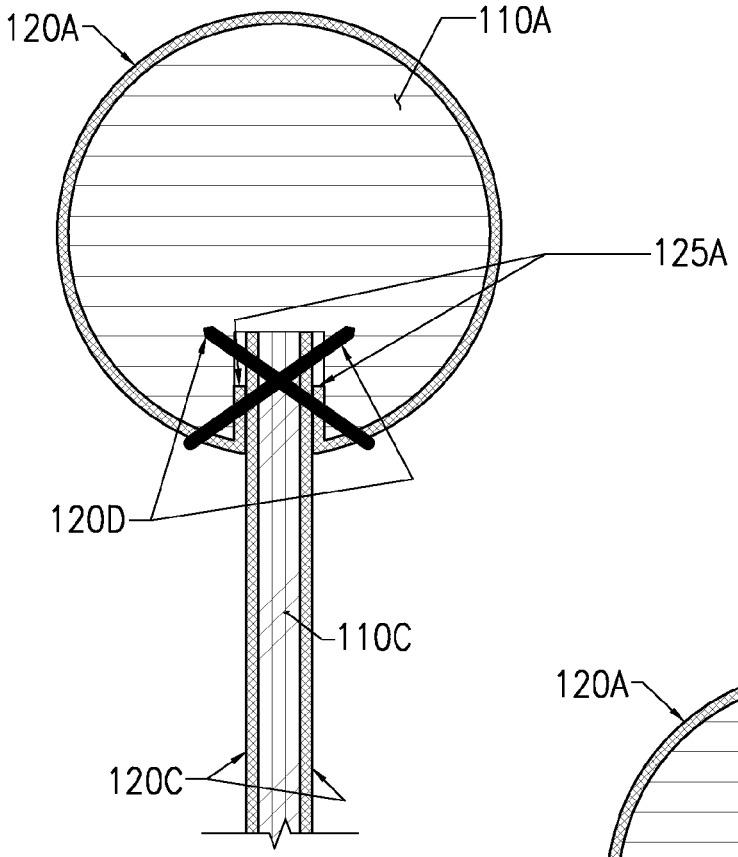
Figure 9C:
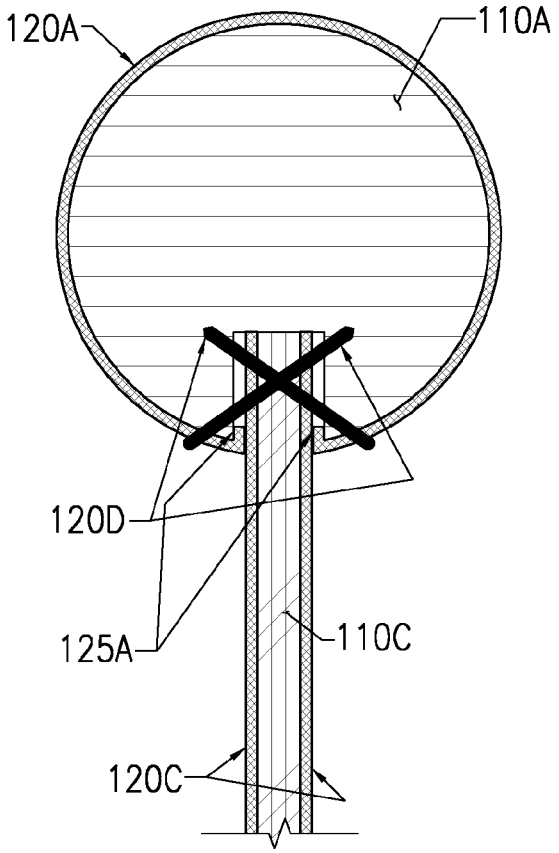

As discussed above, the metal connector 120D can be applied in various manners to cross-section A-A of FIG. 1. The connectors 120D may be applied as a single connector horizontally through the entire width of the top and bottom flanges 120A,B as shown in FIGS. 4A, 5A, and 6A. Alternatively, the metal connectors 120D may be applied as two or more connectors punched through either end of the top and bottom flanges 120A,B in substantially equal increments, such that neither connector pierces entirely through but the sum of each connector covers all of the layers, as shown in FIGS. 4B, 5B, and 6B. The connectors 120D may also be applied as two or more connectors diagonally punched through either end of the top and bottom flanges 120A,B as shown in FIGS. 4C, 5C, 6C, and FIGS. 7A-C and 9A-C. The metal connectors 120D can be used not only to hold the wrapping, but also to connect the top and bottom flanges to the web.

Also discussed above, the metal connector 120D can penetrate various numbers of layers of cross-section A-A of FIG. 1. In more detail, while 6 layers of metal are available, other embodiments have less than 6-layers. There are 6-layers of penetration shown in FIGS. 2, 3 6A, while there are 5 layers shown in FIGS. 5A, 6B, 6C and 9A; 4 layers shown in FIGS. 4A, 5B, 5C, 6D, 8A and 9B; 3 layers shown in 4B, 5D, 6E, 7A, 8B and 9C; 2 layers shown in FIGS. 4D, 5E, 7B and 8C; and only 1 layer shown in FIGS. 4E and 7C. The full 6-layer metal layer embodiments can include 2 layers on the outer side walls of a composite flange perimeter, 2 layers of the inner side walls of the rectangular channel of the top of bottom flange, and 2 layers that sandwich the laminated wedge. Removal of one or both of the wedge layers yields a 5-layer of 4-layer embodiment. Removal of one or both of the inner side walls also yields a 5-layer or 4-layer embodiment. Finally, removal of one or both of the outer side walls yields a 5-layer or a 4-layer embodiment. For example FIG. 5A has a left layer of a wedge but the right layer is removed to leave 5 layers. Various combinations of removing layers yield different 5, 4, 3, 2, or 1-layer embodiments.

The metal covers 120A,B over top and bottom flanges 110A,B can have various configurations (e.g., metal cover flange height 125A,B within channel) on the inner channel which affect the number of layers the connector 120D penetrates. With respect to FIGS. 4A-E, the connector 120D penetrates 4 layers of metal of the metal covers 120A,B in FIG. 4A (i.e., left outer layer, left inner layer, right inner layer, and right outer layer) for metal cover flange height 125A,B of substantially more than half of the inner channel height. However, in FIG. 4B, each horizontal connector 120D penetrates 3 layers (i.e., left outer layer, left inner layer and right inner layer; and right outer layer, right inner layer, and left inner layer), resulting in a single penetration on the outer layers and double penetration on the inner layers. These connectors 120D pierce opposite outer side walls of metal cover 120A and overlap but do not reach the other end to penetrate a fourth layer. Meanwhile, in FIG. 4C, each diagonal connector 120D also penetrates the same 3 layers, albeit from a lower surface of the upper flange 120A rather than a side surface. The diagonal implementation can be easier to manufacture in some cases. But only 2 layers are penetrated in FIG. 4D because the metal cover height 125A is approximately half the channel height, so the end of the metal connector 120D has no metal to pierce, only wood. To a greater extent, only 1 layer is pierced in FIG. 4E because the the metal cover height 125A is even less than half the channel height, so the metal connector 120D has no metal to pierce at all within the channel, only wood. A bottom flange can have the same characteristics or differ.

FIGS. 5A-E have the same configurations as FIGS. 4A-E, except that an additional metal cover 120C is present on the laminated web 120. As a result, the connector 120D now penetrates 5 layers of metal of the metal covers 120A,B in FIG. 5A (i.e., left outer layer, left inner layer, left web layer, right inner layer, and right outer layer). Likewise, in FIG. 5B, each horizontal connector 120D penetrates 4 layers (i.e., left outer layer, left inner layer, left web layer, and right inner layer; and right outer layer, right inner layer, left web layer, and left inner layer), resulting in a single penetration on the outer layers and double penetration on the inner layers. Additionally, in FIG. 5C, each diagonal connector 120D also penetrates the same 4 layers, penetrates 3 layers in FIG. 5D, and only 2 layers in FIG. 5E.

FIGS. 6A-E have the same configurations as FIGS. 5A-E, except that a second additional metal cover 120C is present on the laminated web 120. The connector 120D now penetrates 6 layers of metal of the metal covers 120A,B in FIG. 6A (i.e., left outer layer, left inner layer, left web layer, right web layer, right inner layer, and right outer layer). Further, in FIG. 6B, each horizontal connector 120D penetrates 5 layers, in FIG. 6C, each diagonal connector 120D also penetrates the same 5 layers, penetrates 4 layers in FIG. 6D, and only 3 layers in FIG. 6E.

With respect to the circular top and bottom flanges 120A,B of FIGS. 7A-C, FIGS. 8A-C and FIGS. 9A-C, the metal connector 120 inserted diagonally, pierce through webs with no metal covers, one metal cover, and two metal covers, into channels metal cover heights 125A that are the same as the channel heights, approximately half of the channel heights, and less than half of the channel heights, accordingly. Therefore, FIGS. 7A-C correspond to FIGS. 4C-E in that 3 layers, 2 layers and 1 layer are pierced. Similarly, FIGS. 8A-C correspond to FIGS. 5C-E in that 4 layers, 3 layers and 2 layers are pierced. Finally, FIGS. 9A-C correspond go FIGS. 6C-E in that 5 layers, 4 layers and 3 layers are pierced.

Figure 10:
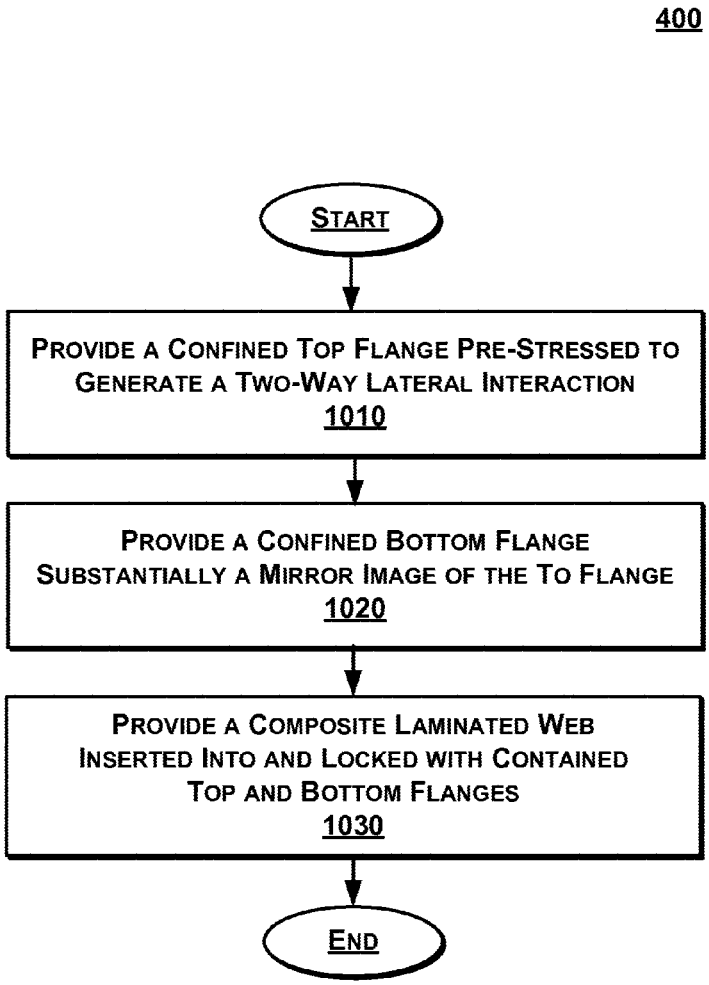
FIG. 10 is a block diagram illustrating a method for producing a composite I-beam to provide support to a structure, according to an embodiment.

FIG. 10 is a flow diagram illustrating a method 1000 for producing a composite I-beam to provide support to a structure.

At step 1010, a confined top flange 110A is provided. The confined top flange can comprise a metal jacket 120A wrapped around an outer perimeter of a wooden core, and along the two inner side walls of a rectangular channel slotted along the wooden core. The metal jacket can be pre-stressed to confine the wooden core. The pre-stress generates a two-way lateral interactions that, in some embodiments, is normal to an interface between the metal jacket and the wooden core. The two-way later interaction allows the member to provide an amount of support surpassing a sum of amount of support provided by the metal jacket and the wooden core when being used separately.

At step 1020, a confined bottom flange 110B is provided. In an embodiment, the confined bottom flange is substantially a mirror image of the confined top flange 110A.

At step 1030, a composite laminated web (120C+110C+120C) is provided. The composite laminated web can have a top edge portion inserted into the slotted channel within the confined top flange 110A and a bottom edge portion inserted into the slotted channel within the confined bottom flange 110B. Then, the laminated web are locked to both top and bottom flanges using metal connectors 120D. The connectors can penetrate the top and bottom flanges in the middle-depth of the slotted channel along the length of the member in various manners as described above.

In summary, the overall load carrying capacity of the composite I-beam 100 is significantly increased through a list of composite actions occurring in the individual components and their connections. Specifically, (1) the compression capacity of the flanges 110A and 110B is increased through the two-way lateral interaction; (2) the tension capacity of the flanges is increased because metal has very high tensile capacity by nature; (3) shear capacity of the web 120 is increased through the one-way lateral interaction; and (4) the shear capacity of the connection is also increased through localized composite action similar to the two-way lateral interaction. The end result is a light weight composite I-beam that has very high strength and ductility.

The disclosure herein is intended to be illustrative, but not limiting, of the scope of the invention, which is set forth in the following claims.

The invention claimed is:

1. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the confined top flange surpassing the sum of amount of support provided by the metal jacket and the wooden core when being used separately;

a confined bottom flange comprising substantially a mirror image of the confined top flange; and a web board, made of wooden materials with a top edge portion inserted into and locked with the confined top flange and a bottom edge portion inserted into and locked with the confined bottom flange, wherein a metal connector penetrates the two side walls of the slotted rectangular channel and four layers of metal including each of the metal jackets on the outer perimeter of the confined top flange and the confined bottom flange and each of the metal jackets on the inner side walls of the slotted rectangular channel of the confined top and bottom flange, and the metal connectors penetrate the web board engaged within the slotted rectangular channel of the confined top and bottom flange.

2. The composite I-beam member of claim 1:

wherein the web board comprises a laminated board having a light-gauged metal cover bonded to wood from a side of the web board, and wherein the metal connectors further penetrate the side walls of the slotted rectangular channel and five layers of metal including each of the metal jackets of the outer perimeter of the confined top flange and the confined bottom flange, each of the metal jackets on the inner side walls of the slotted rectangular channel of the confined top and bottom flange, and the light-gauged metal cover of the laminated web board engaged within the slotted rectangular channel of the confined top and bottom flange.

3. The composite I-beam member of claim 1:

wherein the web board comprises a laminated board having a light-gauged metal cover bonded to a side thereof, wherein the metal cover being laterally supported by the web board which provides a one-way lateral interaction normal to the interface between the metal cover and the web board, and when subjected to shear forces, providing an amount of support to the structure surpassing the amount of support provided by the metal cover when being used without the web board, wherein the metal cover comprises a plurality of teeth that bind the metal cover to the web board to form the laminated web board, and wherein the metal connectors further penetrate the side walls of the slotted rectangular channel and five layers of the metal including each of the metal jackets on outer side walls of a flange perimeter, each of the metal jackets on the inner side walls of the slotted rectangular channel of the confined top and bottom flange, and the metal cover of the laminated web board engaged within the slotted rectangular channel of the top and bottom flange and including the metal cover.

4. The composite I-beam member of claim 1:

wherein the web board comprises an inner wooden board sandwiched between two pieces of light-gauged metal covers, the metal covers being bonded to wood of the web board and being laterally supported by the web board which provides a one-way lateral interaction normal to the interface between the metal covers and the web board, and when subjected to shear forces, providing an amount of support to the structure surpassing the amount of support provided by the metal covers when being used without the inner wooden board, wherein the metal covers each comprise a plurality of teeth that bind each said metal cover to the web board, and wherein the metal connectors further penetrate the side walls of the slotted rectangular channel and six layers of the metal including each of the metal jackets on outer side walls of a flange perimeter, each of the metal jackets on the inner side walls of the slotted rectangular channel of the confined top and bottom flange, and both metal covers of the sandwiched web board engaged within the slotted rectangular channel of the top and bottom flange and including both said metal covers.

5. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing a first amount of support to the confined top flange surpassing the sum of amount of support provided by the metal jacket and the wooden core when being used separately;

a confined bottom flange comprising substantially a mirror image of the confined top flange; and a laminated web board having a light-gauged metal cover bonded to a side thereof, wherein the metal cover being laterally supported by the web board which provides a one-way lateral interaction normal to an interface between the metal cover and the web board, and when subjected to shear forces, providing a second amount of support to the structure surpassing the amount of support provided by the metal cover when being used without the web board, wherein the metal cover comprises a plurality of teeth that bind the metal cover to the web board, wherein two or more metal connectors penetrate the two side walls of the slotted rectangular channel from opposite directions and each of the two or more metal connectors penetrates four layers of metal by a horizontal piercing, wherein a first metal connector of the two or more metal connectors penetrates a first side of an outer perimeter layer of the metal jacket wrapped around one of the top and bottom flange and wherein a second metal connector of the two or more metal connectors penetrates a second side of the outer perimeter layer of the metal jacket opposite of the first side, and both the first and second metal connectors pierce both metal jackets on the inner side walls of the slotted rectangular channel of said one of the confined top and bottom flange and the laminated web board engaged within the slotted rectangular channel of said one of the confined top and bottom flange and including said metal cover.

6. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the confined top flange surpassing the sum of amount of support provided by the metal jacket and the wooden core when being used separately;

a confined bottom flange comprising substantially a mirror image of the confined top flange; and a web board, made of wooden materials with a top edge portion inserted into and locked with the confined top flange and a bottom edge portion inserted into and locked with the confined bottom flange, wherein two or more metal connectors penetrate the two side walls of the slotted rectangular channel from opposite directions and each of the two or more metal connectors penetrates three layers of metal by a horizontal piercing, wherein a first metal connector of the two or more metal connectors penetrates a first side of an outer perimeter layer of the metal jacket wrapped around one of the top and bottom flange and wherein a second metal connector of the two or more metal connectors penetrates a second side of the outer perimeter layer of the metal jacket opposite of the first side, and both the first and second metal connectors pierce both metal jackets on the inner side walls of the slotted rectangular channel of said one of the confined top and bottom flange and the web board engaged within the slotted rectangular channel of said one of the confined top and bottom flange.

7. The composite I-beam member of claim 6:

wherein the web board comprises an inner wooden board sandwiched between two pieces of light-gauged metal covers, the metal covers being bonded to the wooden board and being laterally supported by the wooden board which provides a one-way lateral interaction normal to an interface between the metal covers and the wooden board, and when subjected to shear forces, providing an amount of support to the structure surpassing the amount of support provided by the metal covers when being used without the inner wooden board, wherein the metal covers each comprise a plurality of teeth that bind each said metal cover to the inner wooden board, and wherein the two or more metal connectors further penetrate the two side walls of the slotted rectangular channel from opposite directions and each of the two or more metal connectors penetrates five layers of metal jackets by the horizontal piercing, wherein the first metal connector penetrates the first side of the outer perimeter layer of the metal jacket wrapped around said one of the top and bottom flange and wherein the second metal connector penetrates the second side of the outer perimeter layer of the metal jacket opposite of the first side, and both the first and second metal connectors pierce both metal jackets on the inner side walls of the slotted rectangular channel of said one of the confined top and bottom flange and the sandwiched web board engaged within the slotted rectangular channel of said one of the confined top and bottom flange and including both said metal covers.

8. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the top flange surpassing the sum of amount of support provided by the metal jacket and the wooden core when being used separately;

a confined bottom flange comprising substantially a mirror image of the confined top flange; and a web board, made of wooden materials with a top edge portion inserted into and locked with the confined top flange and a bottom edge portion inserted into and locked with the confined bottom flange, wherein at least two metal connectors diagonally penetrate both side walls of the slotted rectangular channel and one layer of metal including one surface of the metal jacket of an outer perimeter wall of the confined top and bottom flanges, the one surface being a lower surface proximate the slotted rectangular channel of the top flange or an upper surface proximate the slotted rectangular channel of the bottom flange, wherein a first metal connector of the at least two metal connectors penetrates a first side of the one surface and wherein a second metal connector of the at least two metal connectors penetrates a second side of the one surface and the first and second metal connectors pierce opposite of the inner side walls of the slotted rectangular channel of the confined top or bottom flange, wherein a height of both metal jackets of the inner side walls of the slotted rectangular channel of the confined top and bottom flange is less than half a height of the inner side walls of the slotted rectangular channel, and wherein the first and second metal connectors diagonally penetrate the wooden web board engaged within the slotted rectangular channel of the confined top or bottom flange.

9. The composite I-beam member of claim 8:

wherein the at least two metal connectors further diagonally penetrate both side walls of the slotted rectangular channel and two layers of metal including the one surface and also including the two metal jackets of the inner side walls of the slotted rectangular channel of the confined top or bottom flange, wherein the first metal connector further penetrates the metal jacket on a first side of the slotted rectangular channel, and wherein the second metal connector further penetrates the metal jacket on a second side of the slotted rectangular channel, and wherein the height of both metal jackets of the inner side walls of the slotted rectangular channel of the confined top and bottom flange is approximately half the height of the inner side walls of the slotted rectangular channel.

10. The composite I-beam member of claim 8:

wherein the at least two metal connectors further diagonally penetrate the two side walls of the slotted rectangular channel and three layers of metal including the one surface wherein the first metal connector further penetrates both metal jackets on opposite sides of the slotted rectangular channel, and wherein the second metal connector further penetrates both metal jackets on opposite sides of the slotted rectangular channel, and wherein the height of both metal jackets of the inner side walls of the slotted rectangular channel of the confined top and bottom flange is greater than half the height of the inner side walls of the slotted rectangular channel.

11. The composite I-beam member of claim 8, wherein the metal connectors comprise at least one of: a bolt, a rivet, a screw, a nail, and staple.

12. The composite I-beam member of claim 8, wherein a shape of a cross-section of the wooden core of the confined top and bottom flanges is one selected from the group consisting of: a square, a rectangle, and a circle.

13. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the top flange surpassing the sum of amount of support provided by the metal jacket and the wooden core when being used separately;

a confined bottom flange comprising substantially a mirror image of the confined top flange; and a web board with a top edge portion inserted into and locked with the confined top flange and a bottom edge portion inserted into and locked with the confined bottom flange, wherein the web board comprises a laminated web having a light-gauged metal cover bonded to a side of the web board and being laterally supported by the web board which provides a one-way lateral interaction normal to an interface between the metal cover and the web board, and when subjected to shear forces, providing an amount of support to the structure surpassing the amount of support provided by the metal cover when being used without the web board, wherein the metal cover comprises a plurality of teeth that bind the metal cover to the web board, wherein at least two metal connectors diagonally penetrate the two side walls of the slotted rectangular channel and two metal jackets including one surface of a metal jacket outer perimeter wall of the top and bottom flanges, the one surface being a lower surface proximate the slotted rectangular channel of the top flange or an upper surface proximate the slotted rectangular channel of the bottom flange, wherein a first said metal connector penetrates a first side of the one surface and wherein a second said metal connector penetrates a second side of the one surface, and the first and second metal connectors pierce opposite of the inner side walls of the slotted rectangular channel of the confined top or bottom flange, wherein a height of both metal jackets of the inner side walls of the slotted rectangular channel of the confined top and bottom flange is less than half a height of the inner side walls of the slotted rectangular channel, and wherein both of the metal connectors diagonally penetrate the laminated web board engaged within the slotted rectangular channel of the confined top or bottom flange and including the metal cover.

14. The composite I-beam member of claim 13:

wherein the at least two metal connectors further diagonally penetrate the two side walls of the slotted rectangular channel and three metal jackets including the one surface of the perimeter wall, and also including the two metal jackets of the inner side walls of the slotted rectangular channel of the confined top or bottom flange, wherein the first metal connector further penetrates the metal jacket on a first side of the slotted rectangular channel, and wherein the second metal connector further penetrates a second side of the slotted rectangular channel, and wherein the height of both metal jackets of the inner side walls of the slotted rectangular channel of the confined top and bottom flange is approximately half the height of the inner side walls of the slotted rectangular channel.

15. The composite I-beam member of claim 13:

wherein the at least two metal connectors further diagonally penetrate the two side walls of the slotted rectangular channel and four metal jackets including the one surface, wherein the first metal connector further penetrates both metal jackets on opposite sides of the slotted rectangular channel, and wherein the second metal connector further penetrates both metal jackets on opposite sides of the slotted rectangular channel, and wherein the height of both metal jackets of the inner side walls of the slotted rectangular channel of the confined top and bottom flange is more than half the height of the inner side walls of the slotted rectangular channel.

16. A composite I-beam member to provide support to a structure, comprising:

a confined top flange comprising a wooden core and a metal jacket wrapped around an outer perimeter of the wooden core and two opposing inner side walls of a rectangular channel slotted within the wooden core, wherein the metal jacket is pre-stressed to confine the wooden core, providing a two-way lateral interaction normal to an interface between the metal jacket and the wooden core and, when subjected to compression, providing an amount of support to the top flange surpassing the sum of amount of support provided by the metal jacket and the wooden core when being used separately;

a confined bottom flange comprising substantially a mirror image of the confined top flange; and a web board, made of wooden materials with a top edge portion inserted into and locked with the confined top flange and a bottom edge portion inserted into and locked with the confined bottom flange, wherein the web board comprises a wooden board sandwiched between two pieces of light-gauged metal covers, the metal covers being bonded to the web board and being laterally supported by the web board which provides a one-way lateral interaction normal to an interface between the metal covers and the web board, and when subjected to shear forces, providing an amount of support to the structure surpassing the amount of support provided by the metal covers when being used without the web board, wherein the metal covers each comprise a plurality of teeth that bind said metal covers to the web board, wherein at least two metal connectors diagonally penetrate the two side walls of the slotted rectangular channel and three metal jackets including one surface of a metal jacket outer perimeter wall of the top and bottom flanges, the one surface being a lower surface proximate the slotted rectangular channel of the top flange or an upper surface proximate the slotted rectangular channel of the bottom flange, wherein a first said metal connector penetrates a first side of the one surface and wherein a second said metal connector penetrates a second side of the one surface and the first and second metal connectors pierce opposite of the inner side walls of the slotted rectangular channel of the confined top or bottom flange, wherein a height of both metal jackets of the inner side walls of the slotted rectangular channel of the confined top and bottom flange is less than half the height of the inner side walls of the slotted rectangular channel, and wherein both of the metal connectors diagonally penetrate the sandwiched web board engaged within the slotted rectangular channel of the confined top or bottom flange and including both of the metal covers.

17. The composite I-beam member of claim 16:

wherein the at least two metal connectors further diagonally penetrate the two side walls of the slotted rectangular channel and four metal jackets including the one surface and also including the two metal jackets of the inner side walls of the slotted rectangular channel of the confined top or bottom flange, wherein the first metal connector further penetrates a metal jacket on a first side of or proximate to the slotted rectangular channel, and wherein a second metal connector further penetrates a second side of or proximate to the slotted rectangular channel, and wherein the height of both metal jackets of the inner side walls of the slotted rectangular channel of the confined top and bottom flange is approximately half the height of the inner side walls of the slotted rectangular channel.

18. The composite I-beam member of claim 16:

wherein the at least two metal connectors further diagonally penetrate the two side walls of the slotted rectangular channel and five metal jackets including the one surface, wherein the first metal connector further penetrates both metal jackets on opposite sides of the slotted rectangular channel, and wherein a second metal connector further penetrates both metal jackets on opposite sides of the slotted rectangular channel, and wherein the height of both metal jackets of the inner side walls of the slotted rectangular channel of the confined top and bottom flange is more than half the height of the inner side walls of the slotted rectangular channel.

* * * * *